US005175663A

United States Patent [19]

Iwabuchi et al.

[11] Patent Number: 5,175,663

[45] Date of Patent: * Dec. 29, 1992

[54] FUEL PUMP CONTROLLER

[75] Inventors: Hideo Iwabuchi; Takeo Shimada, both of Saitama, Japan

[73] Assignee: Jidosha Kiki Co., Ltd., Japan

[ * ] Notice: The portion of the term of this patent subsequent to Apr. 24, 2007 has been disclaimed.

[21] Appl. No.: 598,033

[22] Filed: Oct. 16, 1990

[30] Foreign Application Priority Data

Oct. 17, 1989 [JP] Japan ..... 1-268198

[51] Int. Cl.[5] ..... F02D 41/00

[52] U.S. Cl. ..... 361/152; 361/154; 123/179.18; 123/479

[58] Field of Search ..... 123/179 L, 497, 499, 123/179.1, 179.18; 361/139, 143, 152, 153, 154, 155, 156

[56] References Cited

U.S. PATENT DOCUMENTS

| | | | |
|---|---|---|---|
| 4,351,299 | 9/1982 | Costello | 361/152 |
| 4,605,983 | 8/1986 | Harvey | 361/154 |
| 4,811,709 | 3/1989 | Braun | 123/357 |
| 4,919,102 | 4/1990 | Iwabuchi | 123/499 |

*Primary Examiner*—Jeffrey A. Gaffin

*Attorney, Agent, or Firm*—Blakely, Sokoloff, Taylor & Zafman

[57] ABSTRACT

The present invention comprises a fuel pump controller having a silicon controlled rectifier (SCR) for supplying a power source voltage to a fuel pump circuit for driving a fuel pump when the SCR is turned on. A timer circuit is also provided for instantly turning on the SCR for a predetermined time period when an ignition switch is initially turned on so as to provide a discharge of fuel into the carburetor before the engine is activated or rotated. In addition, a controller is provided for repeatedly turning on the SCR each time the engine is rotated such that the fuel pump will be driven by rotation of the engine until such engine rotation ceases. By operation of this assembly, fuel is supplied to the carburetor for a predetermined time period before the engine begins to rotate so as to obtain an efficient and quick engine ignition despite the possible initial lack of fuel in the carburetor. Furthermore, since the SCR is thereafter operated by the ignition pulses generated from the engine rotation, the fuel pump will automatically shut off once the engine stops.

6 Claims, 4 Drawing Sheets

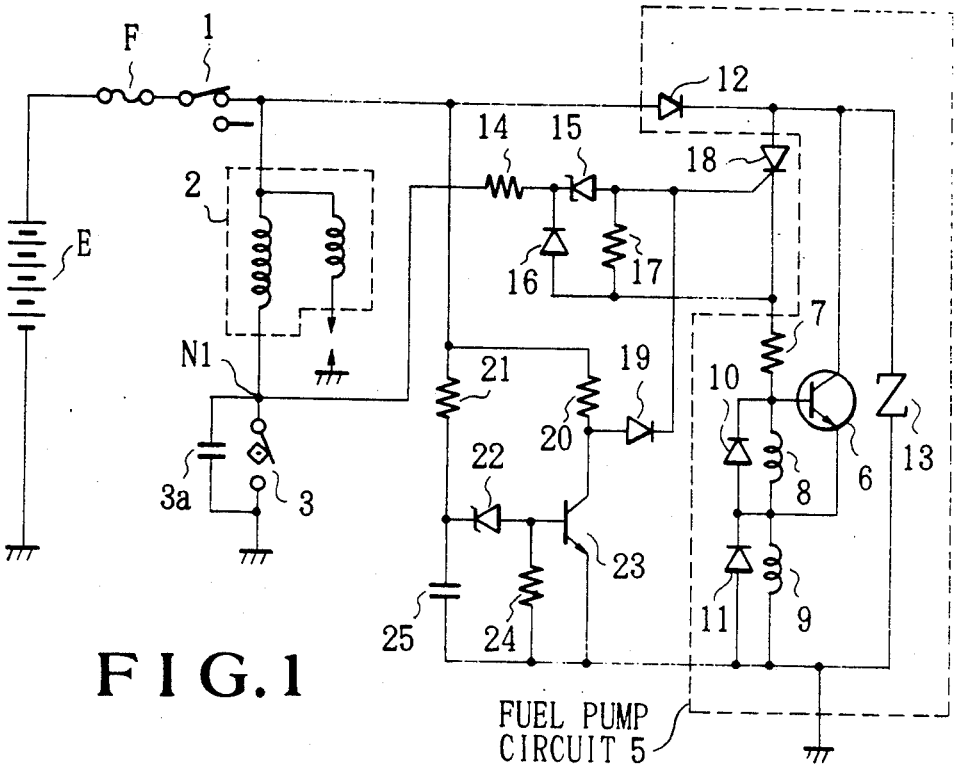
FIG.1
FIG.2A
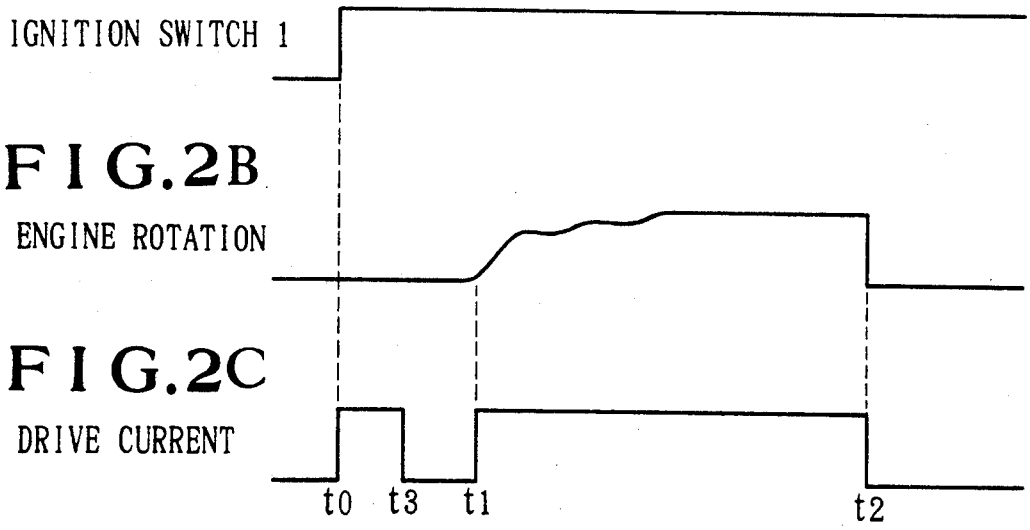
FIG.2B
FIG.2C

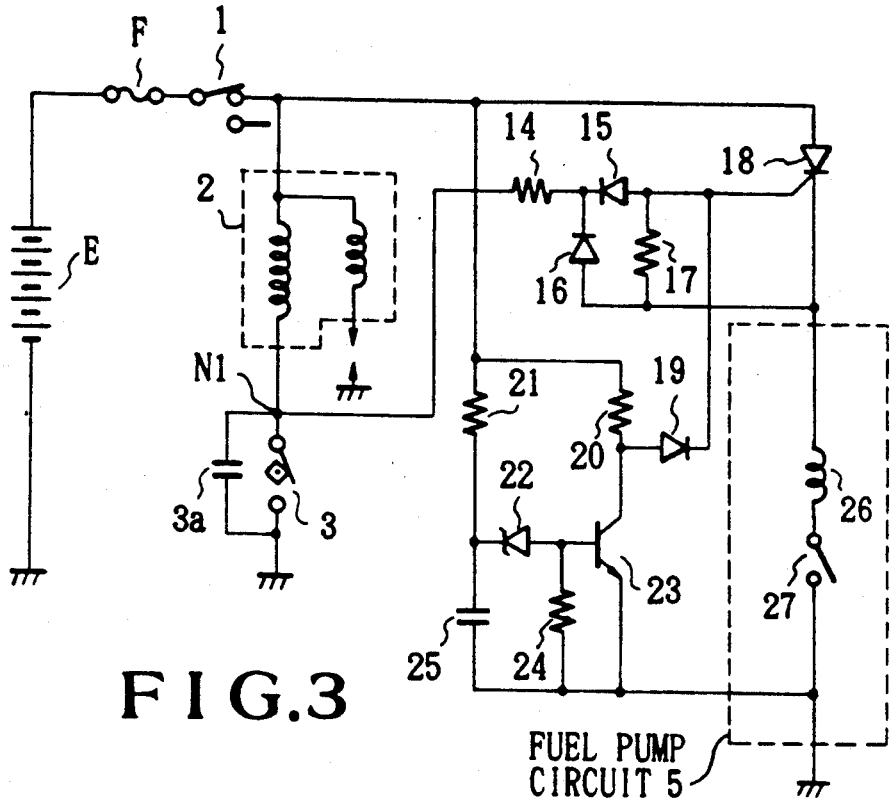
FIG.3
FIG.6A
PRIOR ART
IGNITION SWITCH 1
FIG.6B
PRIOR ART
ENGINE ROTATION
FIG.6C
PRIOR ART
DRIVE CURRENT
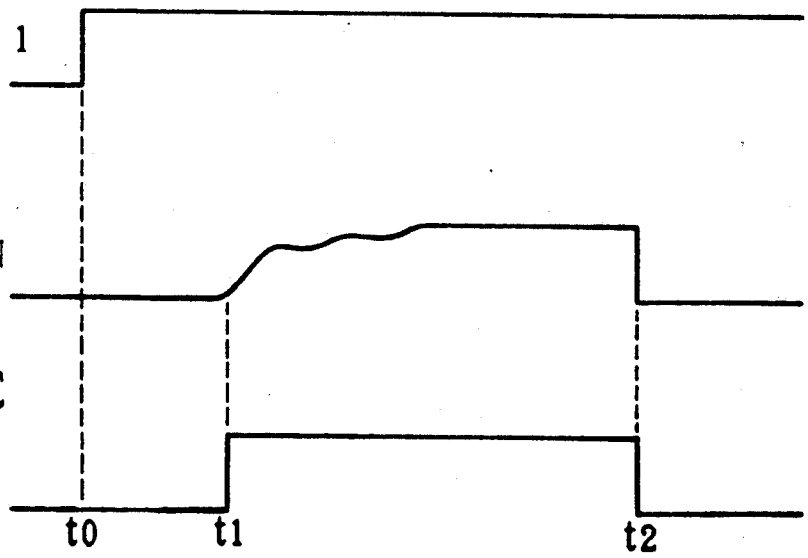

FUEL PUMP CONTROLLER

BACKGROUND OF THE INVENTION

The present invention relates to a fuel pump controller and, more particularly, to starting characteristics of an engine.

FIG. 5 shows a fuel pump driving system using a conventional fuel pump controller. Referring to FIG. 5, reference symbols E and F denote a battery and a fusible link, respectively, and reference numeral 1 denotes an ignition switch; 2, an ignition coil; 3, a point breaker connected in parallel with a capacitor 3*a*; 4, a fuel pump controller; and 5, a fuel pump circuit constituted by a blocking oscillator.

The fuel pump controller 4 includes a waveform shaping circuit WFT connected to a node N1 between the point breaker 3 and the primary side of the ignition coil 2 via a terminal T4, a one-shot circuit OC connected to the output terminal of the waveform shaping circuit WFT, a transistor TR to be turned on/off by an output from the one-shot circuit OC, and a diode D. When an ignition pulse is supplied to the terminal T4, the one-shot circuit 0C turns on the transistor TR for a predetermined time period to connect a power source on the side of a terminal T1 to the fuel pump circuit 5 via a terminal T2.

The fuel pump circuit 5 is constituted by a transistor 6, a biasing resistor 7 for the transistor 6, a signal coil 8, a main coil 9 for driving a fuel pump, diodes 10 to 12, and a varistor 13 serving as a surge absorber for absorbing a surge to protect the transistor 6. Blocking oscillation is caused by an electromagnetic tight coupling between the signal coil 8 and the main coil 9. A fuel pump (not shown) is driven by this blocking oscillation to supply fuel to an engine.

An operation of the conventional system having the above arrangement will be described below with reference to FIGS. 5 and 6A to 6C. As shown in FIG. 6A, the ignition switch 1 is switched on at a time t0. At this time, however, the fuel pump controller 4 does not supply a control current to the fuel pump circuit 5. When the engine is started at a time t1 as shown in FIG. 6C, an ignition pulse is generated at a primary coil of the ignition coil 2, i.e., the node N1 since the point breaker 3 which is turned on/off in accordance with engine rotation is turned off. When the ignition pulse is input to the terminal T4, the terminals T1 and T2 are electrically connected in the fuel pump controller 4 for a predetermined time period. That is, after the ignition pulse is subjected to waveform shaping processing performed by the waveform shaping circuit WFT, it triggers the one-shot circuit OC. Therefore, the one-shot circuit OC outputs a signal to the base of the transistor TR for a predetermined time period to turn on the transistor TR. In this manner, power is supplied from the battery E to the fuel pump circuit 5, and the fuel pump circuit 5 oscillates to drive the fuel pump.

In the fuel pump controller which operates as described above, if engine rotation is stopped at a time t2 (FIG. 6B) due to lateral turnover or crash of a vehicle and an ON/OFF operation of the point breaker is stopped, the ignition pulse is no longer generated to electrically disconnect the terminals T1 and T2, and the control current becomes zero as shown in FIG. 6C. Therefore, the fuel pump stops its operation and discharges no fuel. In this manner, safety for the fuel pump is assured.

In the above conventional fuel pump controller, supply of the control current to the fuel pump circuit 5 is controlled by the ignition pulse generated in accordance with engine rotation, and no control current is supplied to the fuel pump circuit 5 immediately after the ignition switch 1 is switched on.

For this reason, if a vehicle is a new one and left unused for a long time period or left at a high temperature under the blazing sun, the carburetor or piping may be emptied to degrade starting characteristics of an engine.

SUMMARY OF THE INVENTION

The present invention has been made in consideration of the above situation and, has as its object to provide a fuel pump controller which stops its operation when engine rotation is stopped due to lateral turnover or crash of a vehicle and realizes good starting characteristics of an engine.

In order to achieve the above object, a fuel pump controller according to the present invention comprises an SCR for supplying a power source voltage to a fuel pump circuit for driving a fuel pump when the SCR is turned on, a timer circuit for turning on the SCR for a predetermined time period when an ignition switch is turned on, and a controller for turning on the SCR when an engine is rotated.

When the ignition switch is switched on, the fuel pump circuit operates for only a predetermined time period to supply fuel to a carburetor. Therefore, since the fuel is present in the carburetor when the engine is rotated next, the engine can be smoothly started.

BRIEF DESCRIPTION OF THE DRAWINGS

FIG. 1 is a circuit diagram showing a fuel pump driving system using an embodiment of a fuel pump controller according to the present invention;

FIGS. 2A to 2C are timing charts for explaining an operation of the fuel pump driving system shown in FIG. 1;

FIG. 3 is a circuit diagram showing a fuel pump driving system using another embodiment as a fuel pump circuit;

FIGS. 6A to 6C are timing charts for explaining an operation of the fuel pump driving system shown in FIG. 5.

DETAILED DESCRIPTION OF THE PREFERRED EMBODIMENTS

Figure 4A:
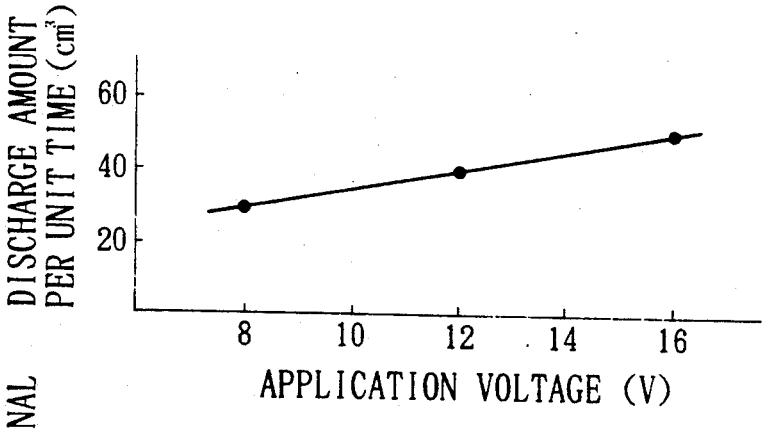
FIG. 4 is a graph for explaining an operation of a timer circuit.

Preferred embodiments of the present invention will be described in detail below with reference to the accompanying drawings.

FIG. 1 shows a fuel pump driving system using an embodiment of a fuel pump controller according to the present invention. Referring to FIG. 1, reference numerals 14 and 17 denote resistors; 15, a Zener diode; 16, a diode; 18, an SCR (Silicon Controlled Rectifier); 19, a diode; 20 and 21, resistors; 22, a Zener diode; 23, a transistor; 24, a resistor; and 25, a capacitor.

Figure 5:
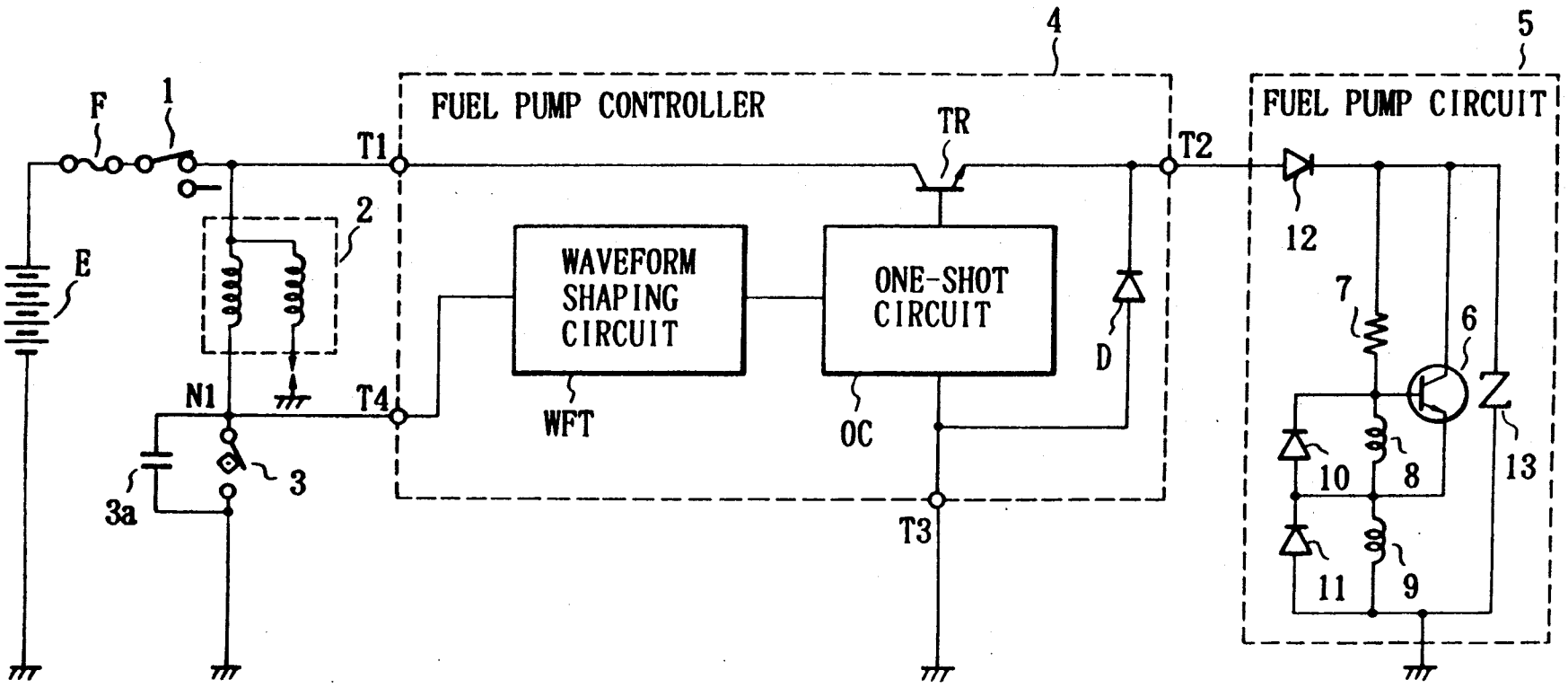
FIG.5 PRIOR ART
FIG. 5 is a circuit diagram showing a fuel pump driving system using a conventional fuel pump controller.

Note that in FIG. 1, the same reference numerals as in FIG. 5 denote the same parts and a detailed description thereof will be omitted.

In this arrangement, the diode 19, the resistors 20, 21, and 24, the capacitor 25, the Zener diode 22, the transistor 23, and the like constitute a timer circuit.

An operation of the system having the above arrangement will be described below with reference to FIGS. 1 and 2A to 2C. When an ignition switch 1 is switched on at a time t0 as shown in FIG. 2A, the timer circuit starts its operation. Initially, an application voltage to the capacitor 25 is low, the base potential of the transistor is the ground potential, and the transistor 23 is OFF. Therefore, a drive current is supplied to the gate of the SCR 18 via the diode 19 to turn on the SCR 18, and a fuel pump circuit 5 starts its operation.

When the application voltage to the capacitor 25 is increased to exceed a Zener voltage of the Zener diode 22 by a time constant determined by the value of the resistor 21 and the value of the capacitor 25, a base current is flowed through and turns on the transistor 23. When the transistor 23 is turned on, a drive current supplied from a battery E to the gate of the SCR 18 via the switch 1, the resistor 20, and the diode 19 becomes zero (at a time t3 shown in FIG. 2C), and the SCR 18 is turned off since an anode current is reduced to be lower than a holding current as will be described later. Since the SCR 18 is turned off, the fuel pump circuit 5 stops its operation, and a fuel pump stops its operation. As a result, fuel supply to a carburetor of an engine is stopped.

When the engine is started at a time t1 as shown in FIG. 2B, an ignition pulse is generated at a primary coil of an ignition coil 2, i.e., a node N1 since a point breaker 3 which is turned on/off in accordance with engine rotation is turned off. This ignition pulse is supplied to the gate of the SCR 18 via the resistor 14 and the Zener diode 15 to turn on the SCR 18. Since the SCR 18 is turned on, an ON current (anode current) of the SCR 18 is flowed through a resistor 7 and coils 8 and 9 of the fuel pump circuit 5, and the fuel pump circuit 5 starts its oscillation. Generally, when an SCR is turned on, it keeps an ON state unless a commutation operation is forcibly performed. In this embodiment, however, since the value of the resistor 7 is set such that the anode current is lower than the holding current, the SCR 18 is naturally turned off without using a forcible commutation circuit nor a means for cutting off a current by using a contact. That is, the SCR 18 is turned on for a predetermined time period by the ignition pulse and kept in this ON state as long as the ignition pulse is input.

When the engine is stopped (FIG. 2B) at a time t2 due to lateral turnover or crash of a vehicle and the ignition pulse is no longer generated, the SCR 18 is kept OFF to set the fuel pump in a non-operative state. In this manner, safety for the fuel pump is assured.

FIG. 3 shows another embodiment of the fuel pump circuit. Referring to FIG. 3, reference numeral 26 denotes a drive coil; and 27, a switch. This embodiment is a contact type fuel pump in which power supply to the drive coil 26 is controlled by an ON/OFF operation of the switch 27.

In the above embodiments, the timer circuit sets its timer time (predetermined time period) by using a time constant circuit constituted by a resistor and a capacitor. As a result, an effect of maintaining a fuel supply amount constant even when a voltage of the battery is decreased can be obtained. The reason for this effect will be described below with reference to FIGS. 4A to 4D.

That is, since a fuel discharge amount of a fuel pump with respect to a carburetor depends on an application voltage, the discharge amount is decreased when the application voltage is decreased (FIG. 4A). When a vehicle is left under the blazing sun for a long time period, a fuel remaining amount in a carburetor is decreased, and a voltage of a battery is decreased. In this state, if an ignition key is turned on to cause a timer circuit to operate a fuel pump for a predetermined time period, a necessary amount of fuel is not supplied to the carburetor.

Figure 4B:
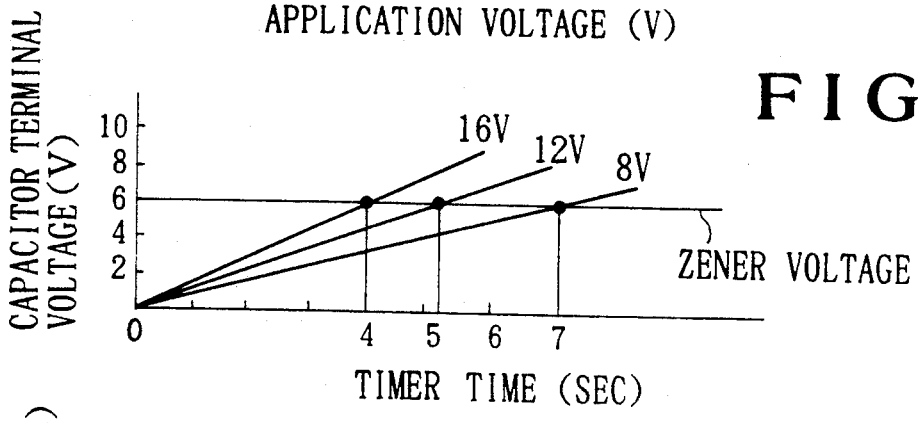
Figure 4C:
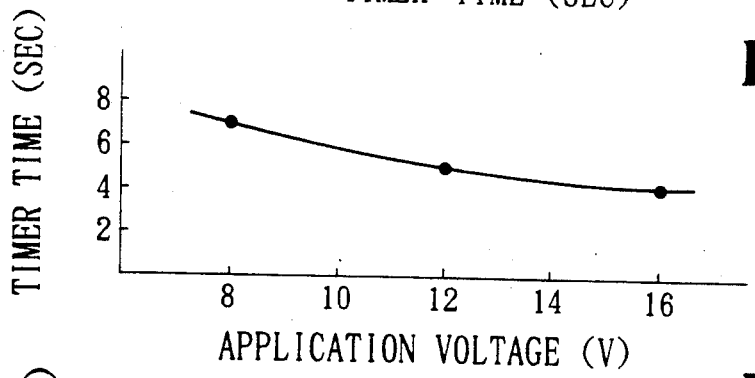
Figure 4D:
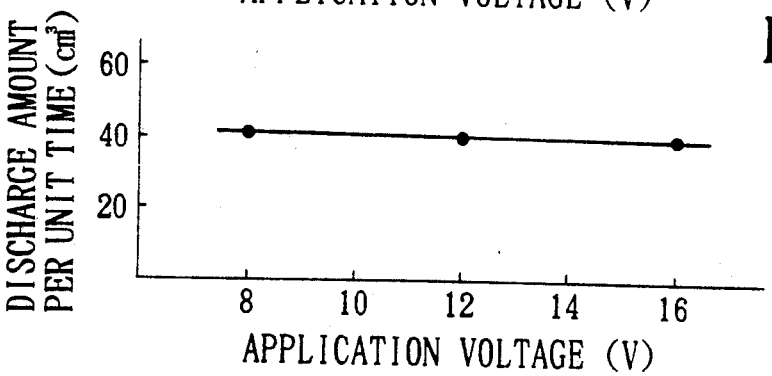

In the timer of the present invention, however, the transistor 23 is turned on when a Zener voltage of the Zener diode 22 exceeds a charged voltage of the capacitor 25 based on a CR time constant of the resistor 21 and the capacitor 25. Therefore, a timer time changes in accordance with a voltage of a battery. As shown in FIG. 4B, the capacitor terminal voltage (charged voltage) changes in accordance with an application voltage. Therefore, the timer time is changed by setting the Zener voltage of the Zener diode 22, i.e., the timer time is prolonged as the application voltage corresponding to the battery voltage is decreased, as shown in FIG. 4C. As a result, as shown in FIG. 4D, a discharge amount of fuel to be supplied to a carburetor can be maintained substantially constant by an operation of the timer circuit even if the application voltage is changed.

Therefore, even if the battery voltage is decreased after a vehicle is left unused for a long time period, a fuel amount to be supplied to the carburetor when the ignition key is turned on can be maintained substantially constant. As a result, a fuel pump controller having good engine starting characteristics regardless of various conditions can be provided.

In addition, this fuel pump controller has only a small number of circuit elements and therefore can be incorporated in a pump. Therefore, a pump having engine starting characteristics better than those of a conventional pump and less expensive than that can be provided.

As has been described above, a fuel pump controller according to the present invention comprises an SCR for supplying a power source voltage to a fuel pump circuit for driving a fuel pump when it is turned on, a timer circuit for turning on the SCR for a predetermined time period when an ignition switch is switched on, and a controller for turning on the SCR when an engine is rotated. Therefore, not only fuel supply can be controlled by an ignition pulse as in a conventional fuel pump controller, but also fuel can be supplied to the engine for a predetermined time period immediately after the ignition switch is switched on. Therefore, a fuel leakage caused by lateral turnover or crash of a vehicle can be prevented to effectively improve engine starting characteristics.

In addition, since a timer time (predetermined time period) of the timer circuit can be controlled to be prolonged as a power source voltage of a battery or the like is decreased, a fuel amount to be supplied to the engine upon operation of the timer circuit can be maintained substantially constant regardless of the voltage. Therefore, the engine can be smoothly started regardless of various conditions.

What is claimed is:

1. A fuel pump controller comprising:

an SCR for supplying a power source voltage to a fuel pump circuit for driving a fuel pump when said SCR is turned on;

a timer circuit for turning on said SCR for a predetermined time period when an ignition switch is turned on; and a controller for turning on said SCR when an engine is rotated.

2. A controller according to claim 1, wherein said controller outputs an ignition pulse generated when a point breaker is turned off.

3. A controller according to claim 1, wherein said timer circuit sets the predetermined time period by a time constant circuit constituted by a resistor and a capacitor.

4. A controller according to claim 3, wherein said timer circuit is arranged by connecting said resistor and said capacitor in series with each other and outputs a signal for turning on a transistor when a voltage at a node between said resistor and said capacitor exceeds a Zener voltage and turning on said SCR when said transistor is turned off.

5. A controller according to claim 1, wherein said fuel pump circuit is constituted by a blocking oscillator.

6. A controller according to claim 1, wherein said fuel pump circuit is constituted by a contact and a drive coil.

* * * * *